United States Patent [19]

Drummond et al.

[11] Patent Number: 4,540,055

[45] Date of Patent: Sep. 10, 1985

[54] DRILL BIT ASSEMBLY HAVING IMPROVED OPERATIONAL LIFE

[75] Inventors: Donald D. Drummond, Jasper; Walter F. Johnsey; Roy W. Wood, both of Birmingham, all of Ala.

[73] Assignee: Drumco, Jasper, Ala.

[21] Appl. No.: 503,265

[22] Filed: Jun. 10, 1983

[51] Int. Cl.[3] ..... E21B 17/22

[52] U.S. Cl. ..... 175/323; 175/324

[58] Field of Search ..... 175/324, 323, 100, 325, 175/393, 394

[56] References Cited

U.S. PATENT DOCUMENTS

| | | | |
|---|---|---|---|
| 572,860 | 12/1896 | Brearley | 175/394 |
| 2,365,941 | 12/1944 | Crake | 175/394 |
| 2,634,101 | 4/1953 | Sloan | 175/324 |
| 2,712,436 | 7/1955 | McCune et al. | 175/323 |
| 2,920,872 | 1/1960 | Baur et al. | 255/24 |
| 3,037,264 | 6/1962 | Mossberg | 29/106 |
| 3,125,175 | 3/1964 | Medlock et al. | 175/228 |
| 3,199,382 | 8/1965 | Andreasson | 77/72 |
| 3,318,398 | 5/1967 | Owen | 175/323 |
| 3,359,837 | 12/1967 | Andreasson | 77/68 |
| 3,370,489 | 2/1968 | Andreasson | 77/72 |
| 3,511,120 | 5/1970 | Kaser | 77/68 |
| 3,543,613 | 12/1970 | Obloy | 77/72 |
| 3,561,299 | 2/1971 | Brisk et al. | 77/55 |
| 3,597,817 | 8/1971 | Whalley | 29/106 |
| 3,798,725 | 3/1974 | Hanson | 29/106 |
| 4,042,048 | 8/1977 | Schwabe | 175/394 |
| 4,080,091 | 3/1978 | Hollinghead | 408/60 |
| 4,083,417 | 4/1978 | Arnold | 175/393 |
| 4,168,925 | 9/1979 | Dufresne | 408/59 |
| 4,372,399 | 2/1983 | Cork | 175/65 |

FOREIGN PATENT DOCUMENTS

| | | | |
|---|---|---|---|
| 744132 | 6/1980 | U.S.S.R. | 175/324 |

*Primary Examiner*—Stephen J. Novosad
*Assistant Examiner*—Hoang C. Dang
*Attorney, Agent, or Firm*—Dann, Dorfman, Herrell and Skillman

[57] ABSTRACT

A drill bit assembly has an elongated housing in which a drill is provided with a generally cylindrical shape for receiving an enlarged tool end with somewhat greater diameter, the tool having cutting cones for cutting a drill hole in material to be drilled. Air is fed to a plenum chamber within the housing out of which are fed two air flows. The first flow is directed to the region of the cutting cones and is of reduced magnitude sufficient only for removing dust and cuttings away from the bit assembly up along the sides of the bit. A plurality of vanes are provided on the housing to direct the first flow into a helical path the general pitch of the vanes. The vanes are caused to overlap one another in the direction of flow. A plurality of jet nozzles are provided from the plenum chamber at the side of the housing intermediate each pair of vanes and aligned so that the second flow will be in line with the first flow and generally parallel to the vanes in the general direction of the drill end and away from the cutting cones. Centrifugal force thus imparted keeps particles away from the drill bit and the pipe extensions and thereby reduces wear.

9 Claims, 2 Drawing Figures

DRILL BIT ASSEMBLY HAVING IMPROVED OPERATIONAL LIFE

BACKGROUND OF THE INVENTION

The present invention relates generally to drill bit assemblies and, more particularly, to such a drill bit assembly having a plurality of rotary cutting cones for use with a rotary drill for drilling into a relatively hard material, such as rock and the like.

DESCRIPTION OF THE PRIOR ART

Typical prior art rotary drill bit assemblies used for drilling into rock or other such relatively hard material comprise an elongated generally tubular housing or adapter sub to which is attached a bit which includes a plurality (generally three) of bearing mounted rotary cutting cones on the lower end thereof. The upper end of the adapter sub is adapted to engage for rotation of rotary drill, either directly or through the use of a suitable extension drill pipe when drilling deep holes. The adapter sub includes a central conduit which extends from the rotary drill (or the extension pipe) to the vicinity of the cutting cones. During the drilling operation, pressurized air from the rotary drill flows (either directly or via the extension pipe) through the central conduit in the adapter sub and is discharged downwardly either directly or through jet nozzles positioned between the rotating cutting cones. The discharged air impinges upon the rock or other such material being drilled and acts as a scavenging medium to pick up dust, cuttings and other such debris and carries them upwardly past the rotating cutting cones and out of the drill hole.

While the above-described prior art drill bits are relatively effective for drilling holes in rock and other such relatively hard materials, they suffer from certain operational drawbacks. It has been found that the high velocity air discharged from the central conduit reacts with the highly abrasive cuttings and dust from the bottom of the drill hole to, in effect, sandblast the cutting cones, thereby providing excessive wear and descreasing their useful service life.

Out co-pending U.S. patent application Ser. No. 435,239, filed Oct. 19, 1982, entitled "Drill Bit Assembly", discloses a drill bit assembly which overcomes many of the drawbacks of the prior art by dividing the pressurized air flow in the adapter sub into two portions to provide a first downwardly directed flow of air to pick up and remove dust and cuttings from the vicinity of the cutting cones, and a second upwardly directed flow of fluid to scavenge the dust and cuttings away from the adapter sub and out of the drill hole. The present invention is a further improvement upon the drill bit assembly of the aforementioned patent application. In the present invention, a flow redirecting means is provided for diverting the second upwardly directed fluid flow in a generally helical path around the outer surface of the drill bit assembly. In this manner, the abrasive effects of the upwardly directed flow of fluid with the entrained dust and cuttings upon the bit assembly and particularly the adapter sub are minimized to provide an improved, longer service life bit assembly.

SUMMARY OF THE INVENTION

Briefly stated, the present invention provides an improved drill bit assembly for a rotary drill. The drill bit assembly has at least one rotary cutting cone for drilling into a relatively hard material, such as rock. The bit assembly comprises an elongated housing having a drill end adapted for attachment to extension means driven by a rotary drill and a tool end, including the cutting cone, for engaging the material to be drilled. A plenum chamber is located within the housing for receiving a supply of pressurized fluid from a fluid source. A first conduit means is provided within the housing for directing a first flow of fluid from the plenum chamber out of the housing adjacent the at least one cutting cone and into a drill hole cut thereby for impingement upon the material to pick up and remove dust and cuttings from the vicinity of the cutting cone. Flow redirecting means are provided for diverting the first fluid flow and the entrained dust and cuttings into a generally helical path around the housing and drill extension means within the bore hole. A second conduit means for discharging a second flow of fluid from the plenum chamber out of the housing remote from and away from the cutting cone and generally toward the drill end of the housing. The first fluid flow is of sufficient magnitude for conveying the dust and cuttings from the vicinity of the cutting cone and into second fluid flow. The second fluid flow is of sufficient magnitude to convey the dust and cuttings from the vicinity of the bit assembly and out of the drill hole and, as necessary, is directed in its movement by the flow redirecting means into the generally helical path.

BRIEF DESCRIPTION OF THE DRAWINGS

The foregoing summary, as well as the following detailed description of the preferred embodiment of the present invention, will be better understood when read in conjunction with the accompanying drawings, in which.

DESCRIPTION OF A PREFERRED EMBODIMENT

Figure 1:
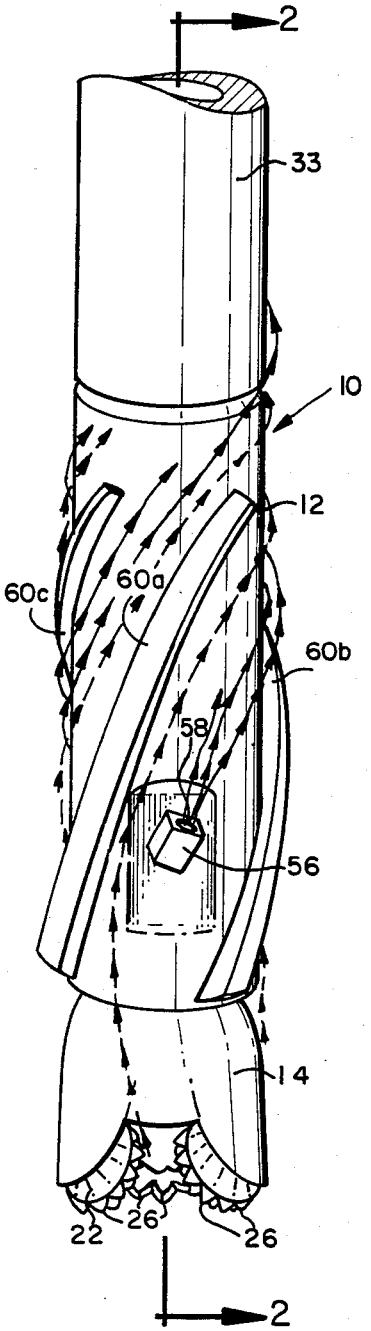
FIG. 1 is a perspective view of a preferred embodiment of the drill bit assembly of the present invention.

Referring to the drawings, there is shown both a perspective and a sectional view of a preferred embodiment of a drill bit assembly, generally designated 10, in accordance with the present invention. A drill bit assembly of the type shown may be used in conjunction with a standard rotary drill (not shown) for drilling into relatively hard material, such as rock or the like (not shown) and has found particular application in connection with coal mining.

The drill bit assembly 10 is generally comprised of two major subassemblies: an adapter subassembly or adapter sub 12 and a bit subassembly or bit 14. The bit 14 comprises an irrregularly shaped housing 18 having a frustoconically-shaped nipple 20 for engaging a complementary sized and shaped tapered socket 21 on the adapter sub 12 as shown. The nipple 20 and socket 21 are threaded as indicated at 16 to releasably secure the adapter sub 12 and the bit 14 to form a complete drill bit assembly 10.

Figure 2:
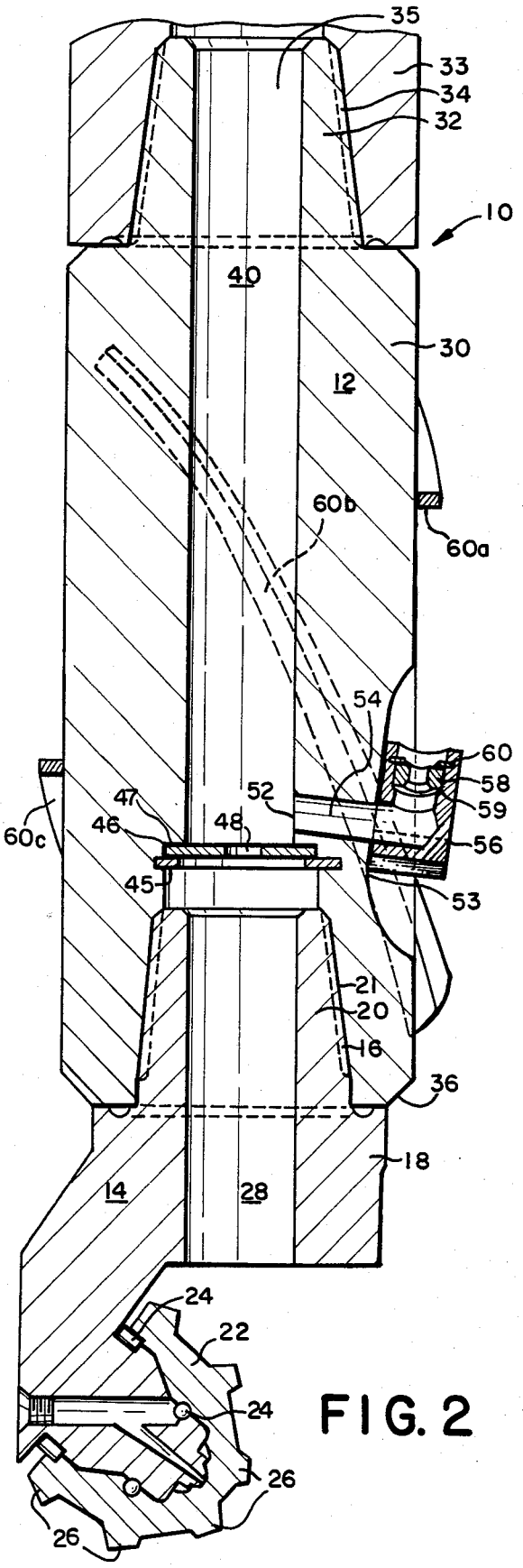
FIG. 2 is a sectional view of FIG. 1 taken along line 2—2 of FIG. 1.

The bit assembly housing 18 is adapted to rotatably support three rotary cutters or cutting cones 22 (only one of which is shown on FIG. 2 for purposes of clarity). The cutting cones 22 are each journalled for independent rotation upon bearings 24 which, in the present embodiment, comprise suitable anti-friction bearings. Suitable sealing means (not shown) may be provided to prevent debris from entering the area between the cutting cones 22 and the underlying supporting housing 18 and from contracting the bearings 24. The exterior surface of each of the cutting cones 22 may include a plurality of cutting teeth 26 which are employed for cutting into rock and other hard materials upon rotation of the drill bit 10 during the drilling operation. The teeth 26, as well as the other components of the cutting cones 22, are generally comprised of (or at least faced with) a relatively hard material such as tungsten carbide or the like. For purposes which will hereinafter become apparent, the bit housing 18 includes a generally cylindrically-shaped open conduit 28 extending centrally therethrough from the end of the nipple 20 to the vicinity of the cutting cones 22.

Bit assemblies of the general type shown and described are well known in the art and may be purchased commercially in various configurations from several bit manufacturing companies, such as Varel Manufacturing Company of Dallas, TX. A more complete description of the detailed structure and operation of the conventional bit may be obtained from the manufacturer, if desired.

The adapter sub 12 is comprised of a generally cylindrically-shaped elongated housing 30 having a first frustoconically shaped drill end 32. The drill end 32 of the housing may include suitable threading 34 and is adapted for engagement with a rotary drill (not shown) usually through the drill pipe extension 33.

The adapter sub housing 30 includes a generally cylindrical bore 40 which extends coaxially through the housing 30 from the drill end 32 to the tool end 36 and which provides the fluid retaining plenum chamber 40. During the drilling operation, pressurized fluid, usually compressed air, from a supply source of air under pressure (not shown) which is maintained within or located adjacent to the surface-mounted rotary drill drive (not shown) is supplied through series of pipes forming the connection to the drill bit assembly. As extension pipes 33 are added, the pressurized air is supplied through a suitable coupling to the pipes to the bore plenum chamber 40 of the bit assembly housing. The pressurized air enters the bore 40 at the first housing end 32. The received air is thereafter distributed in a manner similar to but somewhat modified from that which has been described in our copending U.S. patent application Ser. No. 435,239 and will hereinafter be described in detail.

As in the situation of our earlier invention during the drilling operation, the amount of air exiting the plenum chamber 40 is determined by the size of opening of orifice 48 in annular orifice. The plate 46 is held in place against shoulder 47 by snap ring 45. Since only one orifice plate is used much reduced supply pressure may be used in this device. Flow through opening 48 results in a first air flow which enters the bit conduit 28 and which is very substantially reduced from that supplied to the plenum chamber 40. Much as in the prior art drill bits, the first flow is directed downwardly through a first conduit and is discharged between the cutting cones 22 for impingement upon the material being drilled. It will be observed that the structure at orifice 48 employs a modified structure, which will be explained below. The purpose of the first air flow exiting from the plenum chamber 40 is to cool the surface of the cutting cones 22 and to serve as a circulating medium to pick up and exhaust or remove dust and material cuttings from the drill hole in the vicinity of the cutting cones 22. The force of the first air flow serves to convey the cuttings and dust upwardly past the cutting cones 22 and around the outer surface of the drill bit 10 between the bit and the bore wall.

As discussed briefly above, in the prior art drill bits substantially all of the air from the rotary drill passed at an unreduced pressure through the drill bit and impinged directly upon the material being drilled for the removal of dust and cuttings. It was the high pressure flow of substantially all of the compressed air in this manner which led to the sandblasting effect which caused premature wear of the cutting cones on the prior art drill bits. With the orifice plate construction described above and claimed in aforesaid U.S. patent application Ser. No. 435,239, only a portion of the air from the plenum chamber 40 is directed through the orifice 48 into the first conduit to produce a first flow from the plenum chamber. This first flow leaves the housing adjacent the cutting cones to impinge upon the material being drilled for the removal of the dust and cuttings in the vicinity of the cutting cones 22. By reducing the flow air impinging upon the material, the potential for damage to the cutting cones 22 caused by the sandblasting effect of the highly abrasive cuttings and dust has been greatly reduced from that of the prior art. As discussed below, the first air flow out of the plenum chamber 50 need only be of sufficient quantity and velocity to pick up and remove the dust and cuttings from around the cutting cones 22 and to convey the dust anc cuttings a short distance upwardly to be picked up and removed from the drill hole by a second flow, in a manner as will hereinafter be described.

Three passages 52 (only one of which is shown on FIG. 2) extend from the plenum chamber 40 through the housing 30 to provide second conduit means for discharging a second flow of fluid from the plenum chamber. In this embodiment, the passages 52 are disposed generally equidistantly from each other around the circumference of housing at a common axial level proximate to the annular orifice plate 46. Each passage 52 extending radially outwardly and slightly downwardly toward the bit. Three similar right angle elbow jet nozzle assemblies 56 (only one of which is shown in FIG. 2) are each mounted on a flat surface normal to bore 54 in a niche 53 on the outer surface of the adapter sub housing 30. Each jet nozzle assembly has a jet producing orifice ring 58 for increasing the velocity of flow, which is seated on a shoulder 59 at its outlet and held in place with suitable fastening means, such as a snap ring 60. The nozzles point generally toward the drill end 32 of the housing but are slightly tilted as will be explained and direct the flow against the walls of the bore at a small angle for easy deflection.

During the drilling operation, air from the plenum chamber 40 flows through the second conduit means 52, through the passage 54 and the jet nozzle assemblies 56 and out of the jet nozzle orifices 58 toward the first drill end of the housing as shown by solid line arrows in the drawings. The flow is confined between the walls of the drilled bore hole (not shown) and initially the walls of the housing 30, and thereafter the drill pipe extensions 33. Thus, confined and channelled upward, the flow of air exiting from the jet nozzle orifices 58 operates as a scavenging flow and picks up or combines with the above-described first air flow out of the plenum chamber 50 for further conveying the dust and cuttings removed from the vicinity of the cutting cones upwardly and out of the drill hole. By selection of relative orifice size of orifices 48 and 58, the relative amount of first and second flows of fluid may be adjusted. By, in effect, splitting the flow of air from the plenum chamber 50 in this manner, the first flow is kept at a low level sufficient only to efficiently convey away the abrasive dust and cuttings away from the drill bit 10 and out and up into the second flow resulting in a significant decrease in the sandblasting effect encountered by the cutting cones 22.

The drill bit assembly as thus far described is essentially the same as the drill bit assembly described and claimed in our aforementioned co-pending patent application. This drill bit assembly has been found to be effective in reducing the sandblasting effect upon the cutting cones to thereby provide an improved bit assembly having a longer service life. However, in utilizing this bit assembly, it was discovered that in conveying the highly abrasive dust and cuttings away from the cutting cones and upwardly out of the drill hole, the adapter sub, and particularly the portion of the adapter sub assembly proximate to the three jet nozzles, was subjected to increased wear. The present invention comprises an improvement over the drill bit assembly of our co-pending application which provides for decreased wear of the bit assembly, particularly the adapter sub, therefore leading to a longer service life for the bit assembly.

Again, viewing FIGS. 1 and 2, the outer surface of the lower portion of the generally cylindrical adapter sub housing 30 further includes flow redirecting means, in the present embodiment three guide vanes 60*a*, 60*b* and 60*c* which assume helical paths about the axis of and are mounted on the outer surface of the adapter sub housing 30. The helical pitch as shown is slightly greater than one third turn about the circumference over the length of the housing. This pitch is selected to produce a slight swirl in the second flow as it proceeds along the housing which will continue along the drill extension pipe. The direction of turn of the helical vanes can be either direction and is determined by drill rotation directions. The direction depicted is for the convection clockwise rotation looking into the bore or toward the bit. The helical turn would be reversed were the rotation counterclockwise. The direction is calculated to turn the vanes away from the upward first flow to retreat from the cuttings. The vanes 60*a*, 60*b* and 60*c* are preferably comprised generally of generally heavy guage rectangular members which extend outwardly from the adapter sub housing 30 to which they are affixed by welding. As seen in FIG. 2, the vanes extend the outer dimensions of the housing 30 to almost that of the bit subassembly housing 18. Bits may range widely in diameter from under 4" to over 16" and larger but whatever the size, the diameter at the vanes should be kept at least ⅛" smaller than the bit diameter. In some applications, vanes need not be extended so far. However, when so extended almost to the general diameter of the bit housing 18, it is particularly desirable that they be heavy duty. In such cases, the heavy duty vanes may serve not only to direct fluid flow but also stabilizer bars to guide and support the bit assembly as the drilling proceeds. Particularly in non-vertical drilling this may impose a substantial lateral component of gravitational force on the outer edges of the vanes. Accordingly, the vanes need to be correspondingly rugged in design. Thus, the three guide vanes 60*a*, 60*b* and 60*c* approach or contact the inner circumference of the drill hole and provide added stability to the drill bit assembly 10 during the drilling operation.

In the embodiment illustrated, the guide vanes 60*a*, 60*b* and 60*c* are equally spaced around the outer surface of the adapter sub housing 30 and the length and pitch of each of the vanes is preferably arranged such that each extends over slightly more than 120° of the outer circumferential surface of the lower portion of the adapter sub housing 30 so that there is at least a slight overlap between the upper end of one guide vane (for example, 60*a*) and the lower end of the next guide vane (for example, 60*b*). In general, one end of one guide vane overlaps the other end of the next so that, at the ends of vanes, common elements along the cylindrical surface of housing 30, or a plane passing through the axis and such element, intersect both vanes. The guide vanes 60*a*, 60*b* and 60*c* are positioned so that one of the jet nozzle assemblies 56 is located circumferentially substantially midway between two of the guide vanes as shown on FIG. 1.

During the drilling operation, the guide vanes 60*a*, 60*b* and 60*c* cause the first fluid flow (from conduit 28) and the entrained dust and cuttings which are moving with the first fluid flow upwardly and away from the cutting cones to take an upwardly spiraling path.

As shown on FIG. 1, each of the jet nozzle assemblies 56 is oriented to direct the discharge of the second fluid flow in alignment with the spiraling direction given the first flow. The first flow will be understood to generally envelope housing 30 but as an aid to showing its direction of flow dashed lines with arrows are employed to represent the general direction of the first flow. Preferably, each jet nozzle assembly is located midway between each of two of the guide vanes so that when the second fluid flow combines with first fluid flow and the entrained dust and cuttings, the combined first and second flows move together in alignment to carry the dust and cuttings upwardly in the spiraling motion. In the preferred embodiment shown, the second flow, the direction of which is represented by solid line arrows, spreads out from the nozzles and surrounds the housing in the drill hole as it moves up to exit the drill hole. In variations, however, the nozzle may be oriented as much as 90° off vertical, and nozzle position between the vane can be varied as long as the effect of providing a second flow supporting the first to move dust cuttings upwardly is maintained. By causing the dust and cuttings to move upwardly in such a spiraling manner, perhaps due to a centrifugal effect upon the entraned particles, the abrasive effects of the dust and cuttings upon the adapter sub housing 30 and upon the drill pipe 33 are minimized, thereby leading to an increased service life for those components.

From the foregoing description, it can be seen that the present invention provides an improved, longer service life drill bit assembly having a plurality of rotary cutting cones for drilling into relatively hard material. It will be recognized by those skilled in the art that changes may be made to the above-described embodiment without departing from the broad inventive concepts of the invention. For example, more or fewer vanes can be employed with varying amounts of pitch. Instead of vanes, grooves can be cut into a housing having enlarged diameter. It is understood, therefore, that this invention is not limited to the particular embodiment disclosed but it is intended to cover all modifications which are within the scope and spirit of the invention as defined by the appended claims.

We claim:

1. A drill bit assembly for attachment to a rotary drill for drilling into a hard material, the assembly comprising:

an elongated housing having a drill end adapted for attachment to extension means driven by a rotary drill and a tool end for receiving a bit having at least one cutting cone for engaging and cutting a drill hole into the material to be drilled;

a plenum chamber within the housing for receiving pressurized gaseous fluid from a fluid source;

pressure-reducing means comprising a flow restricting orifice in the plenum chamber to provide a reduced pressure and reduced quantity of flow;

first conduit means communicating with said flow restricting orifice for receiving the reduced flow from the pressure-reducing means and for directing the reduced flow from the plenum chamber out of the housing adjacent the at least one cutting cone and into impingement upon material being drilled to pick up and remove along the housing dust and cuttings from the vicinity of the cutting cone;

flow redirecting means comprising wall means extending less than the full circumference of the housing and supported on the outer surface of the housing for diverting the reduced gaseous fluid flow and the entrained dust and cuttings into a generally helical path around the housing;

second conduit means comprising at least one passage through the wall of the housing above the orifice and having a nozzle outlet positioned for discharging a second flow of gaseous fluid out of the plenum chamber away from the cutting cone and into the helical path; and the relative sizes of the flow restricting orifice and the nozzle outlet being such that the first gaseous fluid flow is sufficient in quantity and velocity for conveying the dust and cuttings from the vicinity of the cutting cone and into the second gaseous fluid flow of a high velocity from the nozzle outlet and of a quantity sufficient to combine with the first flow for conveying the dust and cuttings away from the bit assembly and out of the drill hole, the fluid flows being directed as necessary in movement by the flow redirecting means into the generally helical path.

2. The bit assembly as recited in claim 1 wherein the nozzle outlet is oriented to direct the second flow of fluid generally parallel to and between adjacent pairs of redirecting means.

3. The drill bit assembly as recited in claim 1 wherein the flow redirecting means comprises guide vanes which extend around the outer surface of the housing in a general path to provide a helical segment.

4. The bit assembly as recited in claim 3 wherein the guide vanes at their opposite ends overlap one another along elements of the housing in a plane with the housing axis.

5. The bit assembly as recited in claim 4 wherein the guide vanes are fixed to a cylindrical wall surface of the elongated housing over essentially their entire length, the cylindrical surface being smaller in diameter than the tool.

6. The bit assembly of claim 5 in which the guide vanes extend the outer diameter of the cylindrical wall of the housing to approximately the outer diameter of the tool and are of heavy duty construction to aid in stabilizing the bit in a drill hole.

7. The bit assembly as recited in claim 5 wherein the nozzle outlet is positioned intermediate the vanes to discharge the second flow of fluid in the general direction of the first flow as directed by the vanes, wherein the axis of said nozzle is tilted from a plane in line with the axis of the housing into a line generally parallel to the vanes.

8. The bit assembly as recited in claim 7 wherein each of the second conduit means terminates in a jet nozzle at the opening of an elbow providing a channel through the housing wall, said nozzle and elbow being oriented to direct the second flow of fluid in line with the general path as determined by the vanes.

9. The bit assembly of claims 6, 7, or 8 in which there are three vanes employed with separate second conduit means intermediate each pair of said vanes and wherein the vanes extend around the housing more than 120° of the housing circumference.

* * * * *